US010589895B2

(12) United States Patent
Morimoto

(10) Patent No.: US 10,589,895 B2
(45) Date of Patent: Mar. 17, 2020

(54) SPOUT ASSEMBLY AND PACKAGING CONTAINER

(71) Applicant: TOPPAN PRINTING CO., LTD., Tokyo (JP)

(72) Inventor: Isao Morimoto, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 16/021,864

(22) Filed: Jun. 28, 2018

(65) Prior Publication Data

US 2018/0305072 A1 Oct. 25, 2018

Related U.S. Application Data

(63) Continuation of application No. PCT/JP2016/001883, filed on Apr. 1, 2016.

(30) Foreign Application Priority Data

Feb. 15, 2016 (JP) ..... 2016-026024

(51) Int. Cl.
*B65D 5/74* (2006.01)
*B65D 51/20* (2006.01)
(Continued)

(52) U.S. Cl.
CPC ..... *B65D 5/74* (2013.01); *B65B 61/186* (2013.01); *B65D 5/067* (2013.01); *B65D 5/746* (2013.01); *B65D 51/20* (2013.01)

(58) Field of Classification Search
CPC ..... B65D 5/74; B65D 5/746; B65D 51/20; B65D 5/067; B65B 61/186
See application file for complete search history.

(56) References Cited

U.S. PATENT DOCUMENTS 5,810,184 A * 9/1998 Adams ..... B65D 5/746 215/45
5,957,312 A * 9/1999 Adams ..... B65B 61/186 215/45
(Continued)

FOREIGN PATENT DOCUMENTS

JP H09-226751 A 9/1997
JP 2003-335362 A 11/2003
(Continued)

OTHER PUBLICATIONS

Extended European Search Report dated Dec. 12, 2018 in corresponding application No. 16890431.6.
(Continued)

*Primary Examiner* — Donnell A Long
(74) *Attorney, Agent, or Firm* — Foley & Lardner LLP

(57) ABSTRACT

A spout assembly with a spout and a cap. The spout has a cylindrical sidewall; a cylindrical base at the lower end of the sidewall and having a larger outer diameter than the sidewall; and a disk-like flange extending outward from the lower end of the base. The cap has a cylindrical peripheral wall with an internal thread and is screwed onto the upper end side of the spout sidewall. The spout sidewall also has a projection formed between the external thread and the recess so as to extend circumferentially and have a height lower than a height of the external thread, and with the cap screwed onto the spout, at least a portion of an upper surface of the base fits an inner side of a peripheral wall of the cap.

4 Claims, 8 Drawing Sheets

(51) Int. Cl.
*B65B 61/18* (2006.01)
*B65D 5/06* (2006.01)

(56) References Cited

U.S. PATENT DOCUMENTS

| | | | | |
|---|---|---|---|---|
| 6,129,228 | A * | 10/2000 | Adams | B65D 5/746 215/45 |
| 7,413,097 | B1 * | 8/2008 | Adams | B65D 5/746 215/251 |
| 2001/0015355 | A1 * | 8/2001 | Adams | B65D 5/746 220/258.2 |
| 2003/0071042 | A1 * | 4/2003 | Adams | B65D 5/746 220/258.2 |
| 2006/0124575 | A1 * | 6/2006 | Mavin | B65D 5/746 215/252 |

FOREIGN PATENT DOCUMENTS

| | | | |
|---|---|---|---|
| JP | 2009-083893 | A | 4/2009 |
| JP | 2011-073748 | A | 4/2011 |

OTHER PUBLICATIONS

International Search Report with English language translation and Written Opinion issued in International Application No. PCT/JP2016/001883 dated Jun. 14, 2016.

* cited by examiner

SPOUT ASSEMBLY AND PACKAGING CONTAINER

CROSS-REFERENCE TO RELATED PATENT APPLICATIONS

This application is a continuation application filed under 35 U.S.C. § 111(a) claiming the benefit under 35 U.S.C. §§ 120 and 365(c) of International Patent Application No. PCT/JP2016/001883, filed on Apr. 1, 2016, which is based upon and claims the benefit of priority to Japanese Patent Application No. 2016-026024, filed on Feb. 15, 2016. The disclosures of which are all hereby incorporated herein by reference in their entireties.

TECHNICAL FIELD

The present invention relates to a spout assembly and a packaging container with the spout assembly.

BACKGROUND ART

Some known packaging containers are formed by laminating a barrier layer (such as an aluminum foil, aluminum deposited film, or inorganic oxide deposited film) between a paper substrate layer and a sealant layer of thermoplastic resin, folding the sheet material into a box-like shape, and overlapping and sealing the edges of the sheet material (see PTL 1).

These packaging containers can take various forms. One such packaging container has a gable roof panel formed with a spout assembly and a cap which are made of polyethylene or the like so as to allow liquids inside the container to be poured out. When these packaging containers are disposed of, a container body made of a paper sheet material and a spout assembly welded to it should be separated from each other for separate collection. The container body and spout assembly can be separated by opening the top seal and cutting a sheet material around the spout assembly using scissors or the like. However, these packaging containers are usually hard to break down because the top seal is secure, and spout assemblies are often not separated from them.

PTL 2 discloses a paper package, which is a scored paper container having a spout assembly with an annular thin-walled portion formed on the inner upper surface of its annulus (flange). This paper package is folded along the scores, which causes the annular thin-walled portion to break, allowing a cylindrical section of the spout assembly to be separated from the paper container.

CITATION LIST

[Patent Literature] PTL 1: JP 2003-335362 A; PTL 2: JP 2011-073748 A

SUMMARY OF THE INVENTION

Technical Problem

However, a spout assembly with a thin-walled portion (as described in PTL 2) has a less rigid flange. Because of the reduced rigidity, the shape of its flange is not maintained when the spout assembly is welded to a paper container. This results in non-uniform sealing, which may cause leakage. If the welding is performed at higher energies to prevent this, the spout assembly may break at the thin-walled portion due to the ultrasonic vibration.

The present invention has been made in view of these issues. It is an object of the present invention to provide a spout assembly that is better prevented from breaking from ultrasonic vibration during welding and is more readily separated from a packaging container when being broken down, and a packaging container with the spout assembly.

Proposed Solution to Problem

In one aspect of the present invention to solve the issues, a spout assembly includes a spout and a cap. The spout has a cylindrical sidewall, a cylindrical base provided at the lower end of the sidewall and having a larger outer diameter than the sidewall, and a disk-like flange extending outward from the lower end of the base. The cap has a cylindrical peripheral wall formed with an internal thread and screwed from the upper end side of the spout sidewall. The spout sidewall has an external thread engaging the internal thread of the cap and a recess located between the external thread and the base.

Another aspect of the present invention is a packaging container including a container body having a pouring opening, and the above-described spout assembly having its sidewall inserted into the pouring opening and its flange sealed to the container body.

Desired Advantageous Effects of the Invention

The present invention provides a spout assembly that is better prevented from breaking from ultrasonic vibration during welding and is more readily separated from a packaging container when being broken down, and a packaging container with the spout assembly.

DESCRIPTION OF REPRESENTATIVE EMBODIMENTS

Figure 1:
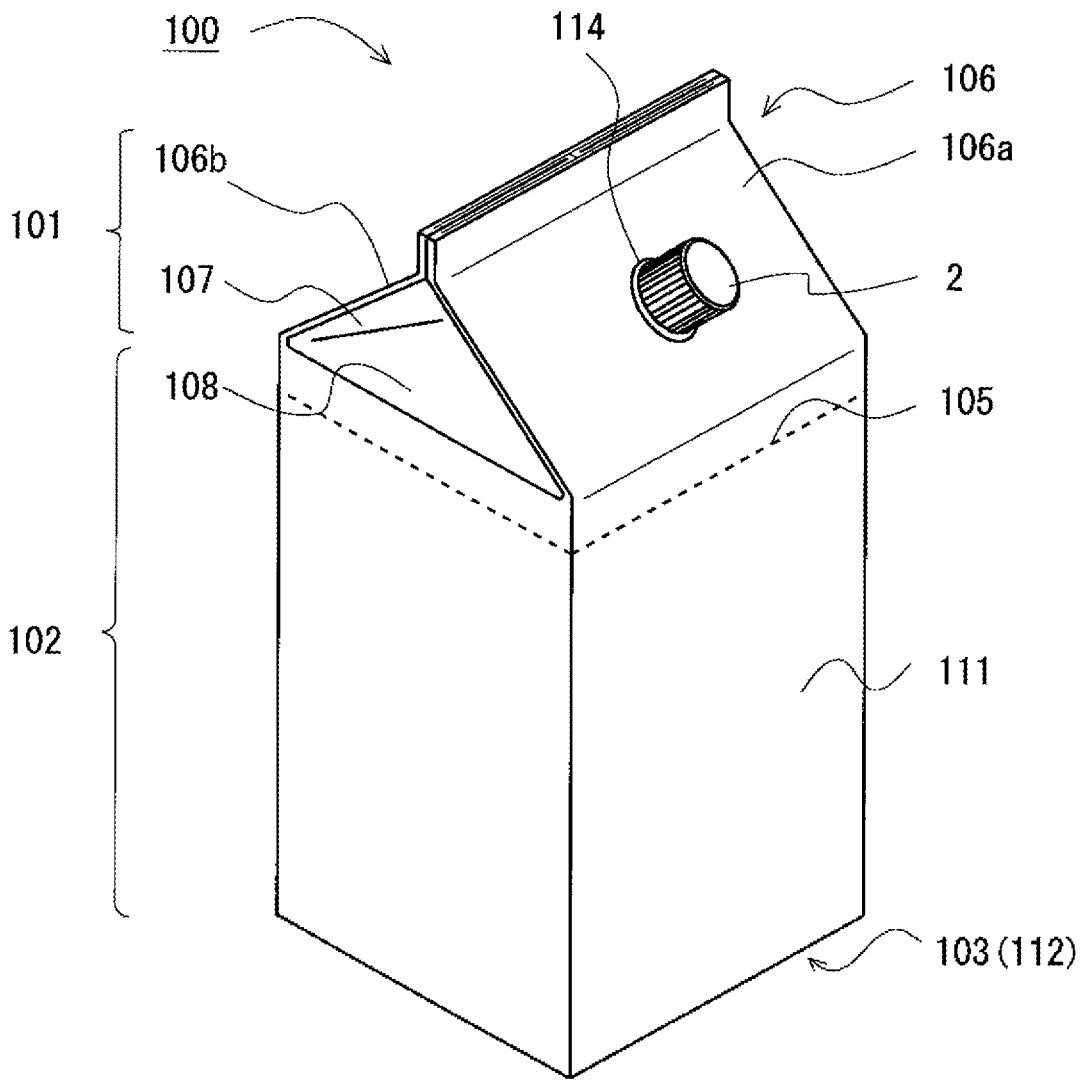
FIG. 1 is a perspective view of a packaging container according to a first embodiment of the present invention.

A packaging container and a spout assembly according to representative embodiments of the present invention will be described with reference to the drawings. It is to be understood that the present invention is not limited to the following embodiments, which are intended to be representative of the present invention. The representative embodiments described below are merely examples of the present invention, and the design thereof could be appropriately changed by one skilled in the art. In the embodiments, the same or corresponding components are denoted by the same reference characters, and description thereof will be omitted.

(Packaging Container)

FIG. 1 shows a perspective view of a packaging container 1 according to a first embodiment. The packaging container 1 includes a container body 100 and a spout assembly 2. The container body 100 is formed by folding a blank 110, which is formed from a sheet material, into a box-like shape, and overlapping and sealing the edges of the blank 110. The spout assembly 2 includes a spout 3 and a cap 4. In one example, the container body 100 includes a top section 101, body section 102, and bottom section 103. These sections respectively serve as a top part, side surface, and bottom part when the container body 100 is erected. The top section 101 includes two roof panels 106 (106*a*, 106*b*), and a fold-back panel 107 and fold-inward panel 108, which are folded between the roof panels 106. The roof panel 106*a* has a circular pouring opening 114 formed therein. The spout assembly 2 is mounted in the pouring opening 114. In one example, four side panels 111 constituting the body section 102 have a weakened portion 105 formed with lower tensile strength. The weakened portion 105 extends around the body section 102 in the lateral direction of the container body 100 in its erected state.

Figure 2:
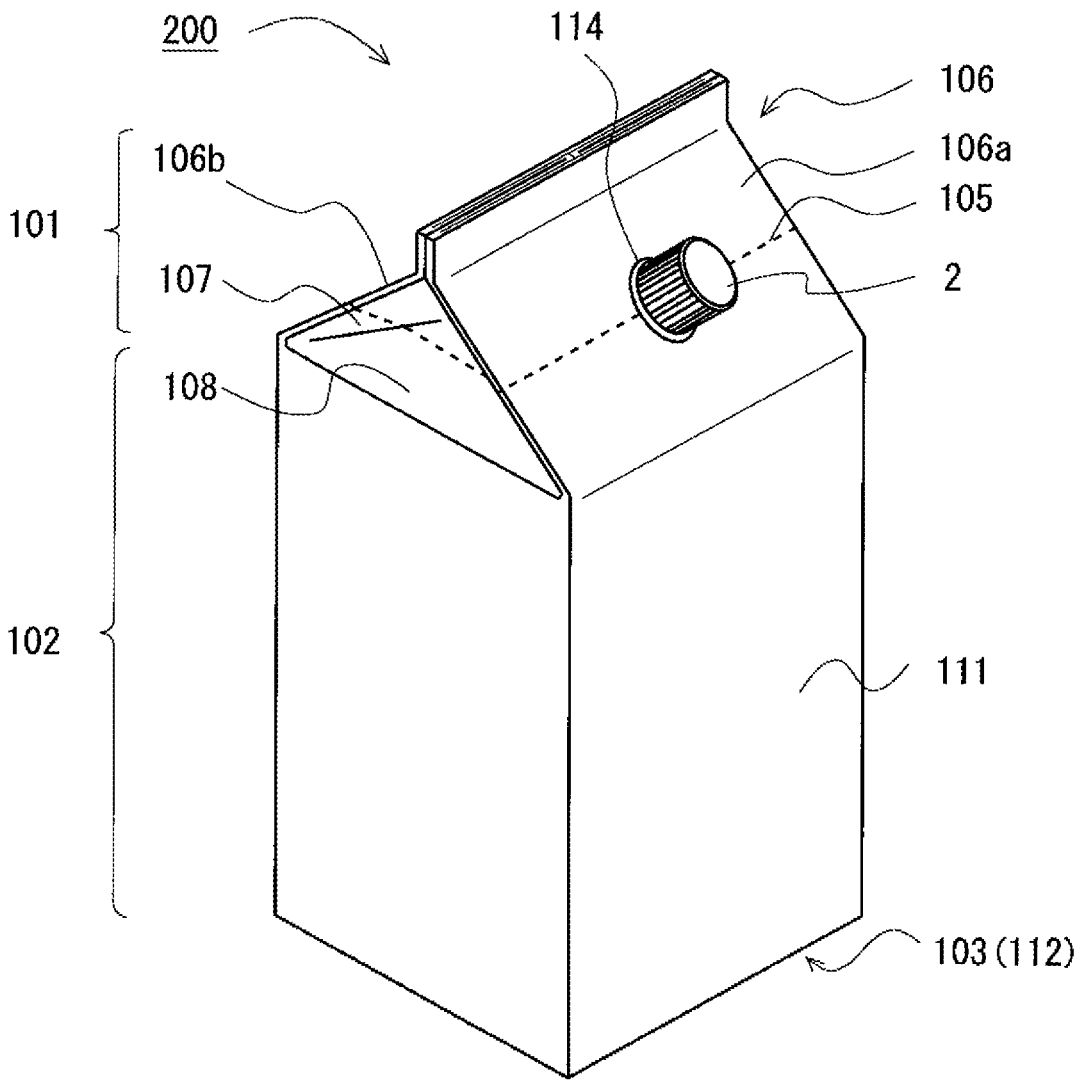
FIG. 2 is a perspective view of a packaging container according to a second embodiment of the present invention.

FIG. 2 shows a packaging container 5 according to a second embodiment. The packaging container 5 includes a container body 200 and a spout assembly 2. The container body 200 is formed by folding a blank 210, which is formed from a sheet material, into a box-like shape, and overlapping and sealing the edges of the blank 210. The packaging container 1 differs from the packaging container 5 in the position of a weakened portion 105. Roof panels 106, fold-back panel 107, and fold-inward panel 108 of the container body 200 have a weakened portion 105 formed extending around the top section 101 of the container body 200.

(Spout Assembly)

Figure 3:
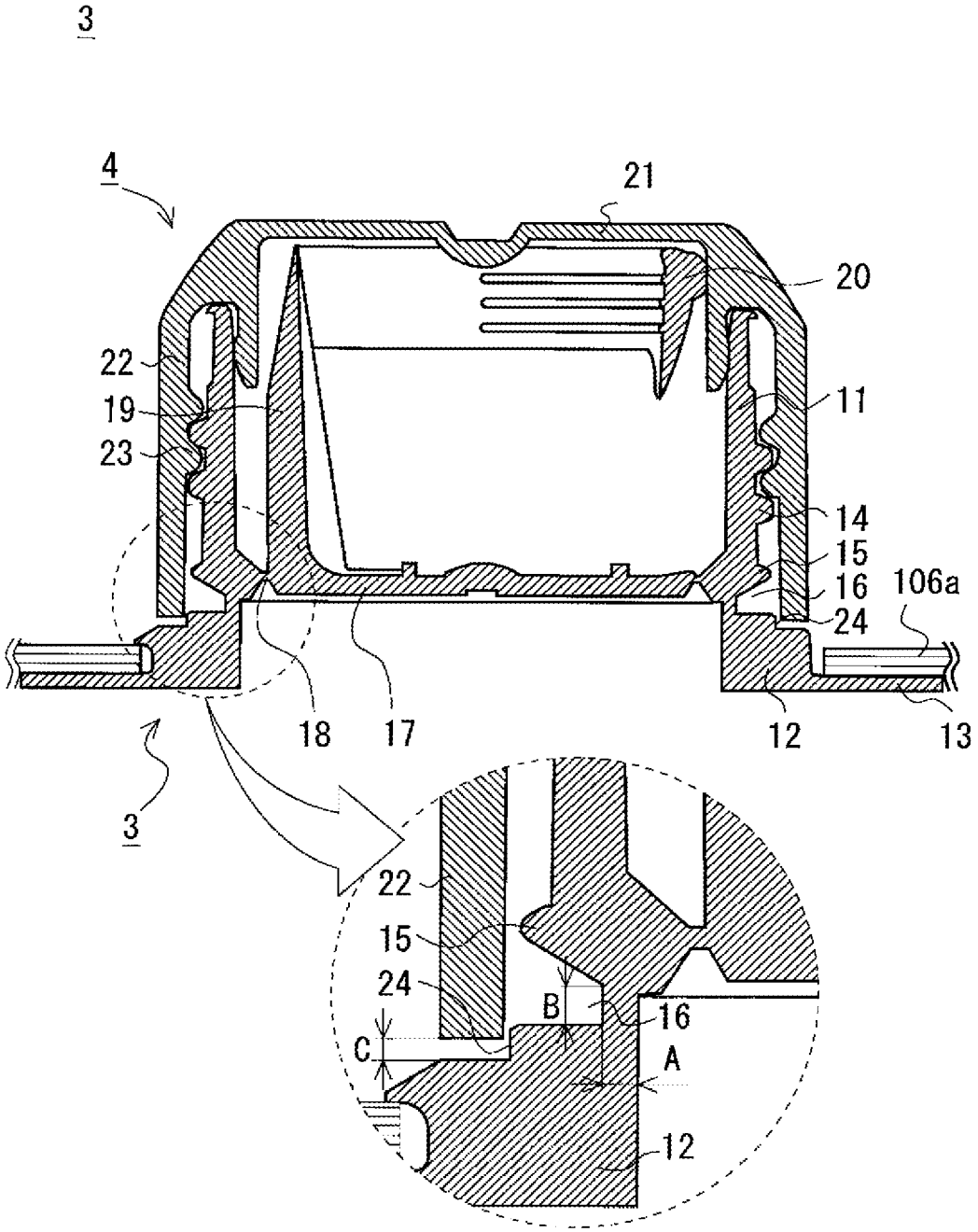
FIG. 3 is a cross-sectional view of a spout assembly according to embodiments of the present invention.

FIG. 3 shows a cross-section view and partial enlarged view of the spout assembly 2 including the spout 3 and cap 4, according to the first and second embodiments. Note that in the description of the spout assembly 2, the vertical directions correspond to those of FIG. 3.

The spout 3*a* includes a cylindrical sidewall 11, a cylindrical base 12 provided at the lower end of the sidewall 11 and having a larger outer diameter than the sidewall 11, and a flange 13 having a disk-like flange extending outward from the lower end of the base 12.

The outer surface of the sidewall 11 has an external thread 14 engaging an internal thread 23 of the cap 4, a projection 15 extending circumferentially and having a height lower than the height of the external thread 14, and a recess 16 located between the projection 15 and base 12, in this order from the upper end side. The inner surface of the sidewall 11 has a disk-like partition wall 17 provided via a half-cut portion 18 to close the upper end side and the lower end side. The partition wall 17 is formed with a pull ring 20 via a pillar 19.

The cap 4 includes a circular top plate 21, a cylindrical peripheral wall 22 descending from the outer periphery of the top plate 21, and the internal thread 23 formed on the inner surface of the peripheral wall 22 and engaging the external thread 14 of the spout 3.

As shown in FIG. 3, the peripheral wall 22 is formed such that at least a portion (fitting portion 24) of the upper end of the base 12 fits the inner side of the peripheral wall 22 when the cap 4 is screwed onto the spout 3. With the peripheral wall 22 thus formed, the fitting portion 24 and the projection 15 face the inner surface of the peripheral wall 22 when the cap 4 is screwed onto the spout 3, as shown in the enlarged view of FIG. 3. As used herein, the term "screw" refers to the process of aligning the internal thread 23 of the cap 4 and the external thread 14 of the spout 3 and rotating the cap 4 and spout 3 in the opposite directions to engage the internal and external threads. Furthermore, "the state where the cap 4 is screwed onto the spout 3" means the cap 4 is fully screwed onto the spout 3 and, for example, touches the upper end of the sidewall 11.

As shown in FIG. 3, the recess 16 is preferably formed on the lower end side of the sidewall 11 in a position below the partition wall 17. The recess 16 thus formed allows the recess 16 and half-cut portion 18 to be tested for leakage independently when the spout 3 is leak-tested.

As shown in FIG. 3, the width of the recess 16, or the width between the projection 15 and the base 12, may be constant or decreases toward the center of the sidewall 11. Furthermore, ribs may be provided to divide the recess 16 circumferentially. The recess 16 thus formed allows the rigidity of the sidewall 11 to be adjusted as needed. This recess 16 also prevents a flange 13 of a spout 3 from engaging a recess 6 of another spout 3, which would otherwise stop the feeding of spouts 3, when, for example, large numbers of spouts 3 are stored in random positions as with parts feeders.

The thickness A defined by the bottom of the recess 16 and the inner surface of the sidewall 11 is preferably 0.20 mm or more and 1.00 mm or less, more preferably 0.40 mm or more and 0.80 mm or less. If the thickness A is less than 0.20 mm, pinholes easily form during the manufacturing process, while the thickness A of more than 1.00 mm makes separation of the spout assembly 2 difficult. Preferably, the width B between the projection 15 and the base 12 at the bottom of the recess 16 is 0.50 mm or more. If the width B is less than 0.50 mm, the durability of a mold greatly decreases. Preferably, the clearance C between the lower end of the peripheral wall 22 and the base 12 is 0.15 mm or more and 0.40 mm or less.

The material for the spout 3 may be a low-density polyethylene resin or the like, while the material for the cap 4 may be a polypropylene resin or high-density polyethylene resin having a greater rigidity than a low-density polyethylene resin. The spout 3 is preferably made of a material having a flexural modulus of 100 MPa or more and 180 MPa or less, more preferably 120 MPa or more and 155 MPa or less. The spout 3 and cap 4 can be integrally formed, for example.

In one example, the spout 3 is mounted by joining a surface of the flange 13 on the sidewall 11 side to the inner surface of a roof panel 106*a* of the container body 100, 200 by ultrasonic welding.

(Blank)

Figure 4:
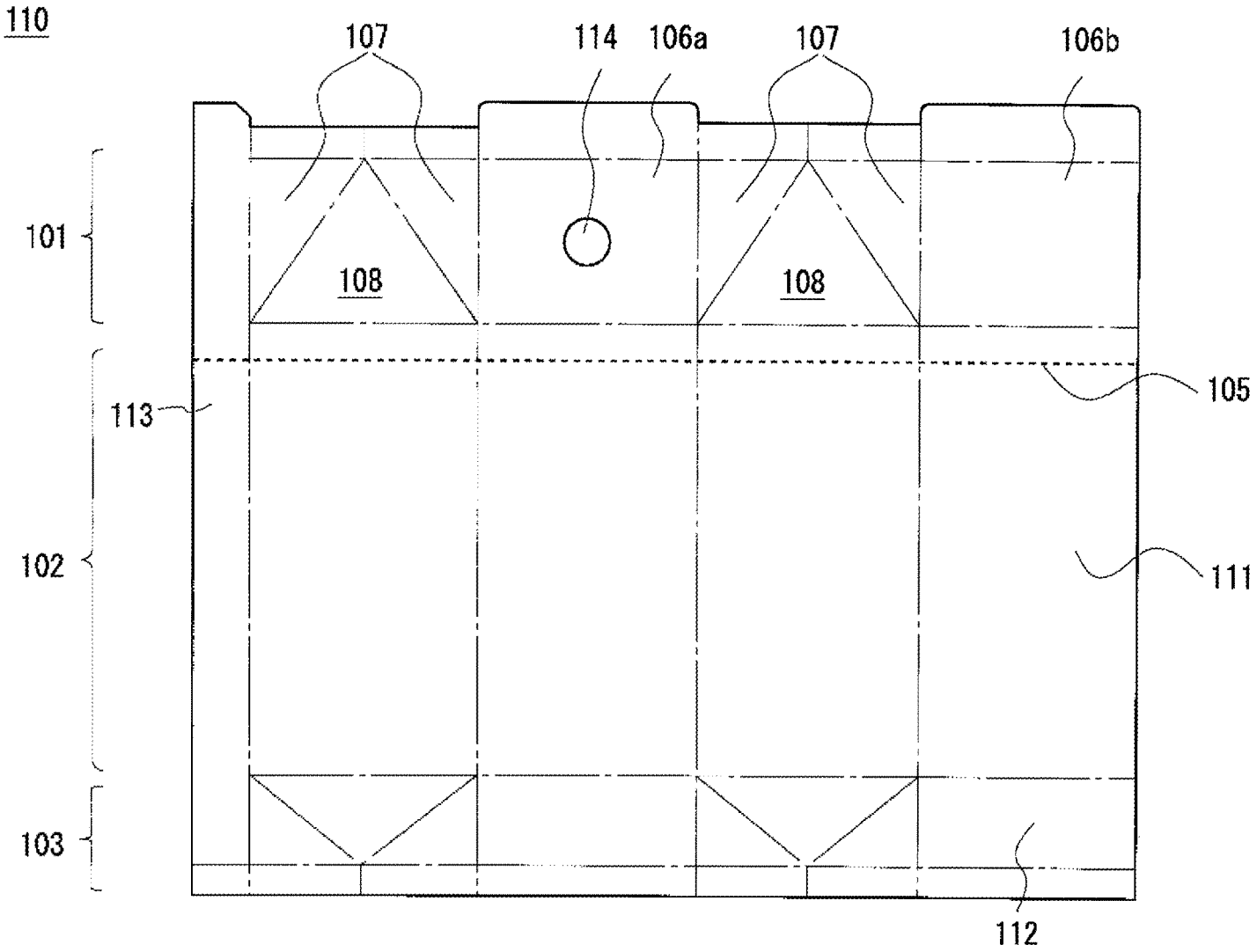
FIG. 4 is a plan view of a blank according to the first embodiment of the present invention.

FIG. 4 is a plan view of a blank 110, which is an example blank used to form a container body 100 according to the first embodiment. The blank 110 includes roof panels 106*a*, 106*b* that constitute a top section 101, a fold-back panel 107 and fold-inward panel 108, four side panels 111 that constitute a body section 102, a bottom panel 112 that serves as a bottom section 103, and a to-be-sealed section 113 formed at an edge of the blank 110. The blank 110 is folded along a chain line (FIG. 4), and the to-be-sealed section 113 is sealed to an edge on the opposite side thereof. The blank is thus formed into a box-like shape. Around the center of the roof panel 106*a* is a pouring opening 114 in which the spout assembly 2 is fixedly mounted. The side panels 111 are formed with a linear weakened portion 105 laterally extending across substantially the entire width of the container body 100 in its erected state.

Figure 5:
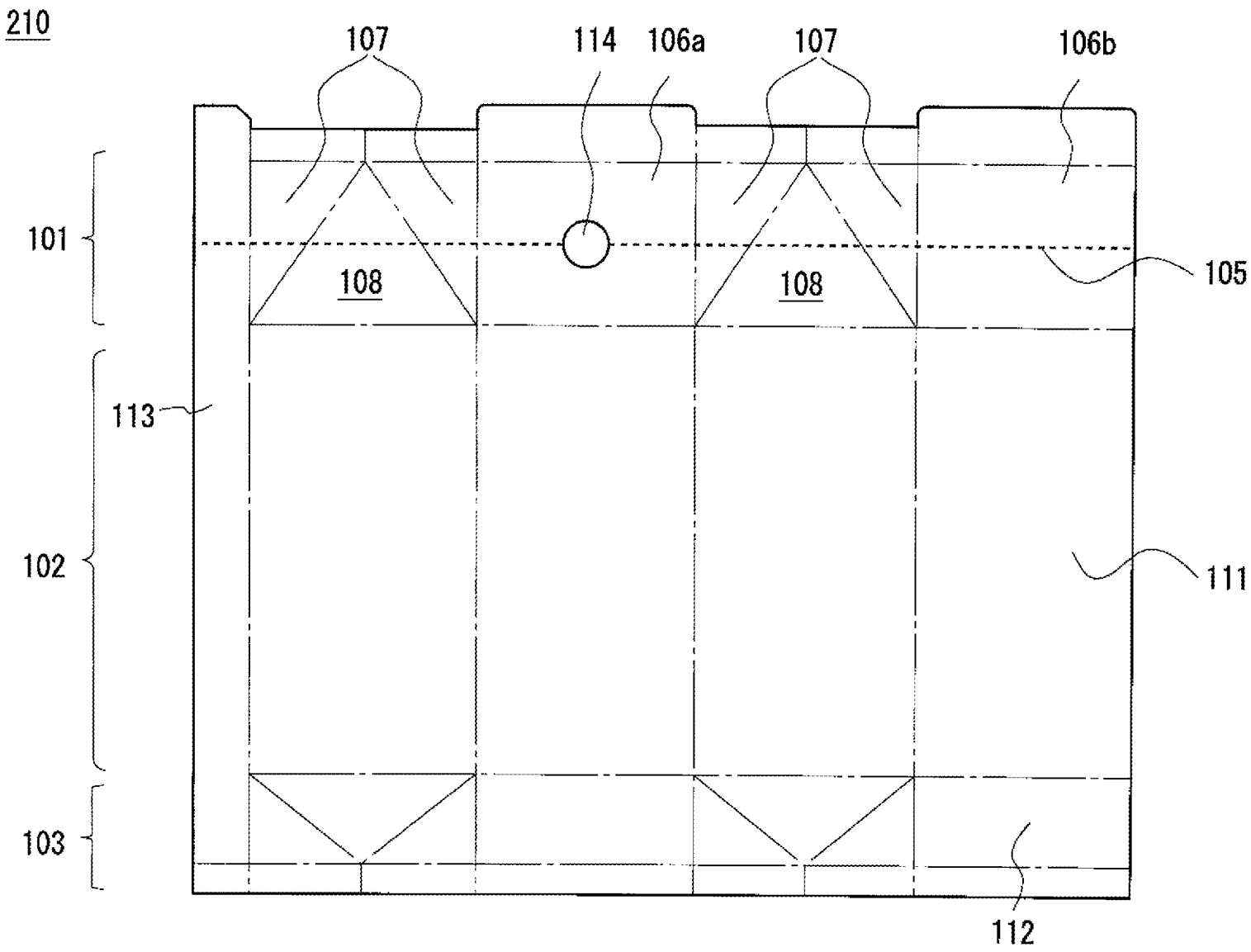
FIG. 5 is a plan view of a blank according to the second embodiment of the present invention.

FIG. 5 is a plan view of a blank 210, which is an example blank used to form a container body 200 according to the second embodiment. The blank 110 differs from the blank 210 in the position of a weakened portion 105. The weakened portion 105 of the blank 210 extends around roof panels 106, fold-back panel 107, and fold-inward panel 108 in the lateral direction of the container body 200 in its erected state. Part of the weakened portion 105 is interrupted by the pouring opening 114. Therefore, a crease formed when the container body 200 is folded along the weakened portion 105 passes through the pouring opening 114. The weakened portion 105 may be formed in the longitudinal direction or any direction of the container body 200 as long as part of it is interrupted by the pouring opening 114.

The blank 110, 210 can be formed of a known sheet material such as a laminate including a paper substrate layer and a barrier layer. The weakened portion 105 is constituted by groove-like cut portions each formed in the paper substrate layer and/or the barrier layer of the blank 110, 210 and having a predetermined depth. The cut portion may have any depth that provides sufficient strength of the packaging container 1. The cut portion may be formed by a half-cutting process or full-cutting process using, for example, a cutting die, or by laser beam machining. The weakened portion 105 may be perforations to allow the packaging container 1 to have sufficient strength, or may have a linear shape.

The blank 110, 210 and the container body 100, 200 are not limited to the embodiments. The container body 100, 200 may be of brick type having a rectangular parallelepiped shape, Tetra Pak type having a tetrahedral shape, or any type as long as they can be formed by folding a blank into a box-like shape, and overlapping and sealing the edges of the blank. Therefore, a blank for the container body 100, 200 can also take any form. The weakened portion 105 may not be formed.

(Separation Method 1)

A description will be given of an example method of separating the spout assembly 2 of the packaging container 1 according to the first embodiment. FIGS. 6A through 6D each show a process in a separation method 1 for the spout assembly 2.

<Flattening Process>

Figure 6A:
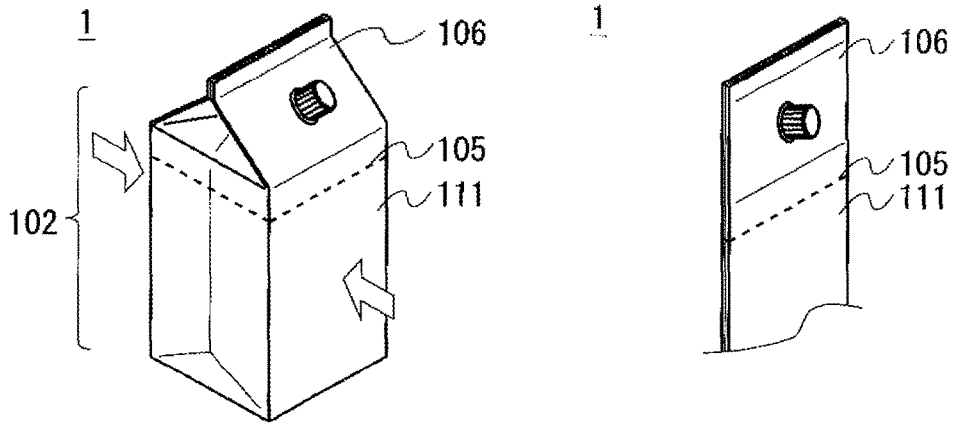
FIG. 6A shows an example method of separating the spout assembly according to the first embodiment of the present invention.

FIG. 6A shows a process of flattening the packaging container 1. In this process, the user of the packaging container 1 presses the opposing two side panels 111, which extend down from the roof panels 106, in opposing directions, to flatten the body section 102. The other two side panels 111 in contact with the pressed side panels 111 and the fold-inward panels 108 are folded inwardly of the packaging container 1.

<Roof Panel Separation Process>

Figure 6B:
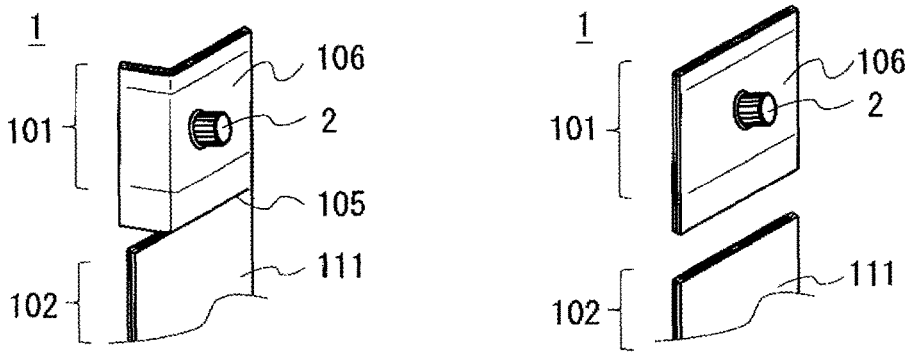
FIG. 6B shows the example method of separating the spout assembly according to the first embodiment of the present invention.

FIG. 6B shows a process of separating the roof panels 106 with the spout assembly 2 from the packaging container 1 along the weakened portion 105. In this process, the user tears part of the side panels 111 along the weakened portion 105. Consequently, an upper portion of the body section 102 and the roof panels 106 of the packaging container 1 are separated from a lower portion of the body section 102.

<Folding Process>

Figure 6C:
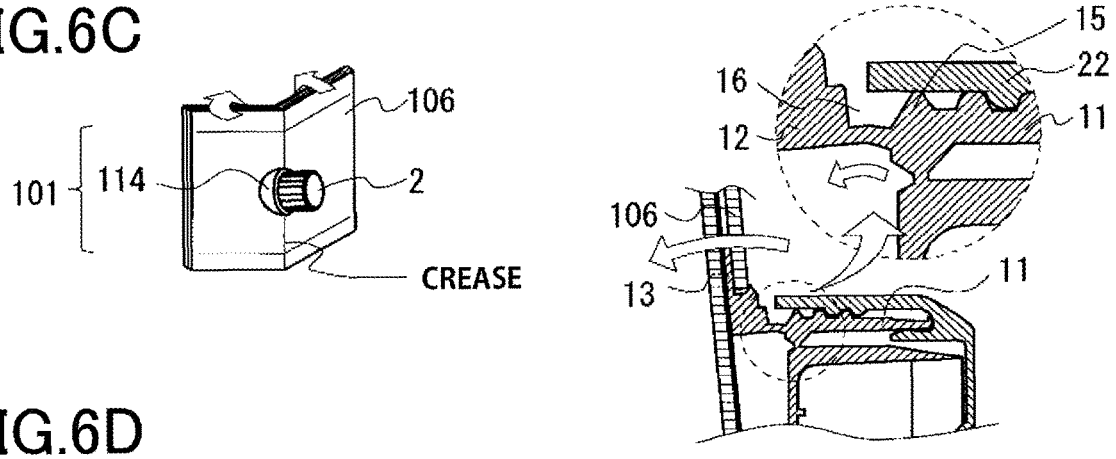
FIG. 6C shows the example method of separating the spout assembly according to the first embodiment of the present invention.
Figure 6D:
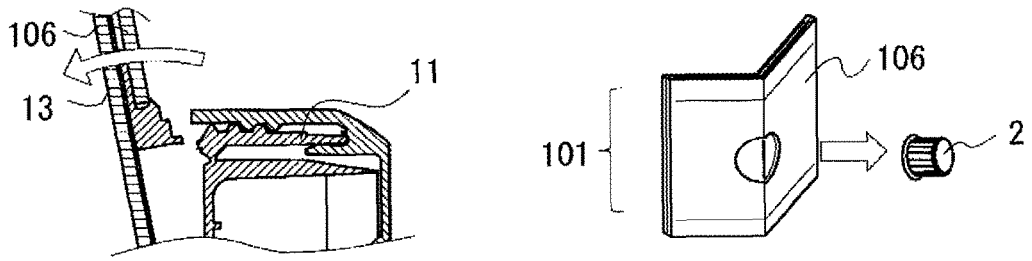
FIG. 6D shows the example method of separating the spout assembly according to the first embodiment of the present invention.

FIGS. 6C and 6D show a process of folding the separated roof panels 106. In this process, the user folds the roof panels 106 near the center thereof in the lateral direction of the container body 100 in its erected state. This results in the roof panels 106 having a crease passing through the pouring opening 114. Therefore, a portion of the flange 13 of the spout mounted in the pouring opening 114 is bent in the same direction as the roof panels 106 when subjected to a load. While the roof panels 106 can be folded in any position as long as a crease formed passes through the pouring opening 114, they can be folded more readily in a position near the lateral center thereof because the fold-inward panels 108, folded inwardly of the packaging container 1, do not overlap the roof panels 106.

As shown in FIG. 6C, folding the flange 13 causes the sidewall 11 of the spout 3 to deform so as to extend in the direction in which the roof panels 106 are folded. However, the projection 15 of the sidewall 11 comes into contact with the peripheral wall 22 of the cap 4 upon deformation of the sidewall 11. Consequently, the deformation of the sidewall 11 due to deformation of the roof panels 106 is inhibited by the sidewall 22 formed of highly rigid material.

By further folding the roof panels 106, the flange 13 further folds, which causes a portion of the sidewall 11 forming the bottom of the recess 16 to be bent, generating a large stress at the portion. At least a portion of the sidewall 11 breaks when the deformation of the roof panels 106 progresses to the extent that a stress acting on the sidewall 11 exceeds a certain value. By further folding the roof panels 106 after the breakage of the sidewall 11, the sidewall 11 is circumferentially broken further.

<Spout Assembly Separation Process>

FIG. 6D shows a process of separating the spout assembly 2 from the packaging container 1. At least partially broken in the former process, the portion of the sidewall 11 forming the recess 16 allows the user to cut the spout 3 with little effort, and to thus separate the spout assembly 2 from the packaging container 1.

(Separation Method 2)

A description will be given of an example method of separating the spout assembly 2 of the packaging container 5 according to the second embodiment. FIGS. 7A through 7D each show a process involved in a separation method 2 for the spout assembly 2.

<Flattening Process>

Figure 7A:
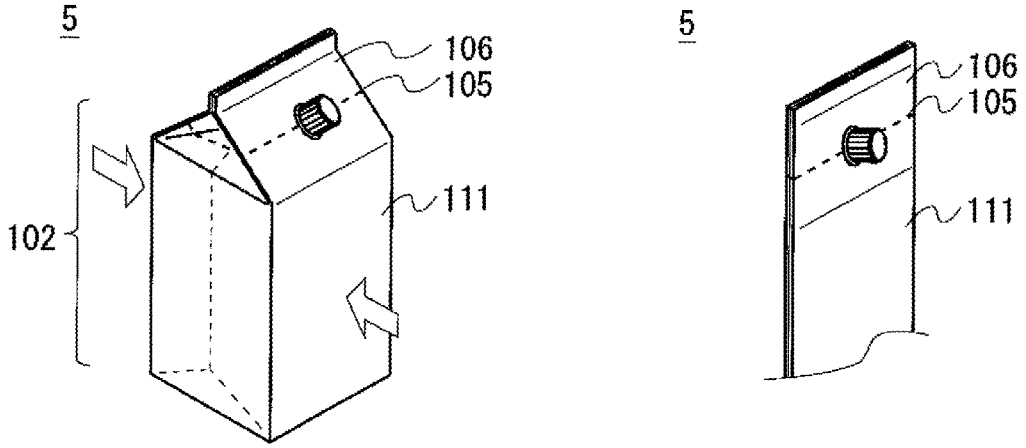
FIG. 7A shows an example method of separating the spout assembly according to the second embodiment of the present invention.

FIG. 7A shows a process of flattening the packaging container 5. In this process, the user of the packaging container 5 presses the opposing two side panels 111, which extend down from the roof panels 106, in opposing directions, to flatten the body section 102. The other two side panels 111 in contact with the flattened side panels 111 and the fold-inward panels 108 are folded inwardly of the packaging container 5.

<Folding Process>

Figure 7B:
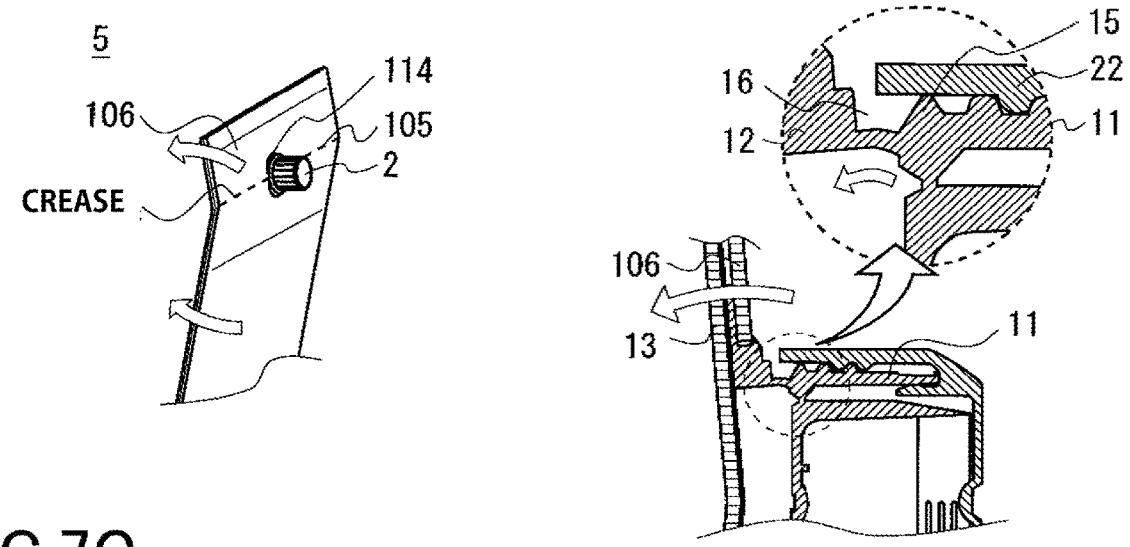
FIG. 7B shows the example method of separating the spout assembly according to the second embodiment of the present invention.
Figure 7C:
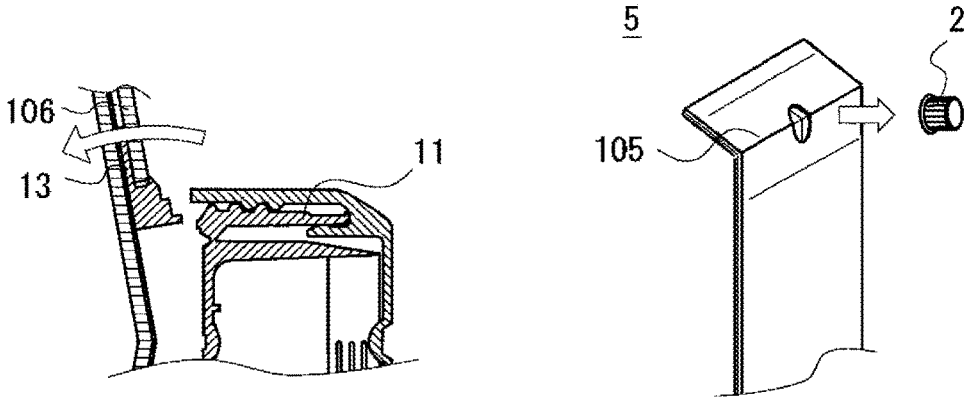
FIG. 7C shows the example method of separating the spout assembly according to the second embodiment of the present invention.

FIGS. 7B and 7C show a process of folding the packaging container 5 along the weakened portion 105. In this process, the user folds the roof panels 106 along the weakened portion 105. This results in the roof panels 106 having a crease passing through the pouring opening 114. Therefore, a portion of the flange 13 of the spout mounted in the pouring opening 114 is bent in the same direction as the roof panels 106 when subjected to a load.

Subsequently, the flange 13 is folded as shown in FIG. 7B, so that at least a portion of the sidewall 11 breaks as shown in FIG. 7C. This process is the same as that of the separation method 1, and thus description thereof is omitted here.

<Spout Assembly Separation Process>

FIG. 7C shows a process of separating the spout assembly 2 from the packaging container 5. At least partially broken in the former process, the portion of the sidewall 11 forming the recess 16 allows the user to cut the spout 3 with little effort, and to thus separate the spout assembly 2 from the packaging container 5.

In the embodiments, the projection 15 of the spout 3 comes into contact with the peripheral wall 22 when the roof panels 106 are folded with a cap 4 of highly rigid material screwed thereto. This configuration allows the cap 4 to inhibit deformation of the sidewall 11. Consequently, a portion of the sidewall 11 forming the bottom of the recess 16 connecting the base 12 with the sidewall 11 bends, resulting in stress being concentrated on this portion. Thus, the user of the packaging container 1 can easily separate the spout assembly 2.

Providing the projection 15 on the sidewall 11 of the spout 3 thickens a portion of the sidewall 11 at its lower end. This allows the sidewall 11 to have sufficient rigidity, which prevents the half-cut portion 18 from breaking due to ultrasonic vibration. Furthermore, the sidewall 11 inclines less during screwing of the cap, thus preventing the occurrence of overrun. Here, the overrun refers to situations where the sidewall 11 inclines inwardly to the extent that the internal thread 12 of the cap 4 climbs over the external thread 14 when excessive torque is applied to the cap 4 after being screwed.

The recess 16 is formed in a portion of the sidewall 11 positioned away from the flange 13 through which ultrasonic vibration are transmitted during welding. This configuration makes non-uniform welding less likely to occur than when a thinned portion is formed in the flange 13.

The fitting portion 24 comes into contact with the cap 4 when lateral loads are applied to the spout assembly 2. This configuration prevents the lateral loads from being directly applied to the recess 16, and thus from breaking the spout 3 from the bottom of the recess 16. Note that the embodiments can be modified. For example, the projection 15, fitting portion 24, and the like are provided as needed, depending on the strength or the like required of the spout assembly, and may not be formed.

EXAMPLES

Spout assemblies of Examples 1, 2, and 3 and a Comparative Example were produced. These spout assemblies were each welded to a gable top container body 100 formed from a blank including a 85 mm square paper substrate for two-liter containers. Then, the spout assemblies were subjected to assessment of ease of breakdown, measurement of overrun torque, drop test, and measurement of dimensions.

Example 1

As Example 1, a packaging container 1 with a spout assembly 1 welded to a container body 100 was produced. The welding was performed on the conditions that sealing energy was 113 J, amplitude was 83%, frequency was 30 kHz, and sealing time was 0.22 seconds or less.

Example 2

As Example 2, a packaging container 1 with a spout assembly 1 welded to a container body 100 was produced. The welding was performed on the conditions that sealing energy was 130 J, amplitude was 89%, frequency was 30 kHz, and sealing time was 0.22 seconds or less.

Example 3

Figure 8A:
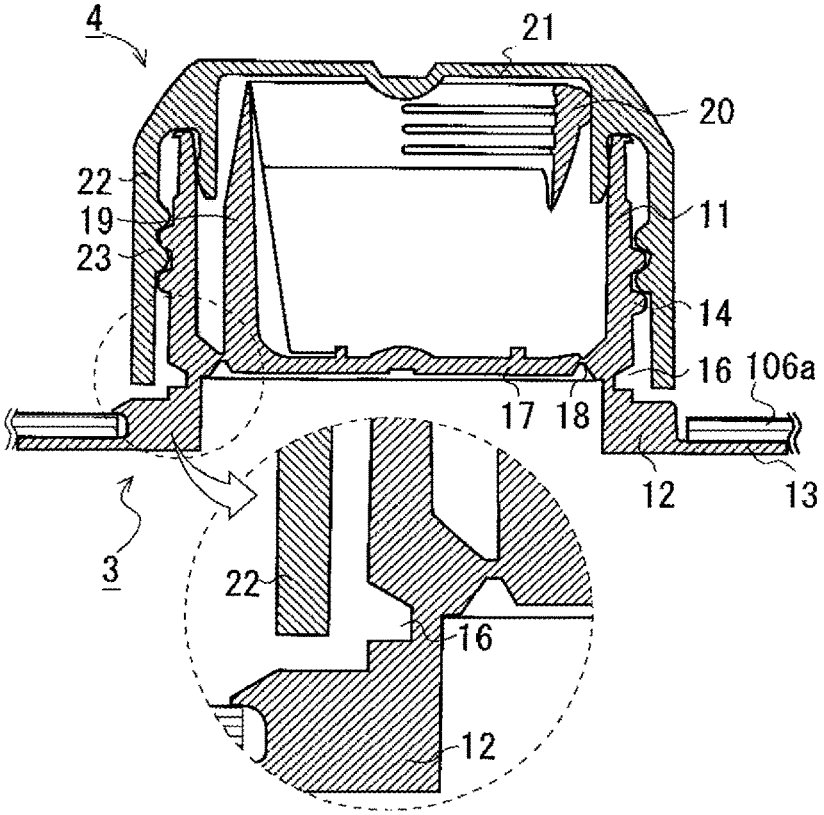
FIG. 8A is a cross-sectional view of a spout assembly according to a modification of the present invention.

As Example 3, a modification of the spout assembly 1 was produced that had no projection 15 and fitting portion 24, and was welded to a container body 100 to produce a packaging container. The welding conditions were the same as Example 1. FIG. 8A is a cross-sectional view of the spout assembly of Example 3.

Comparative Example

Figure 8B:
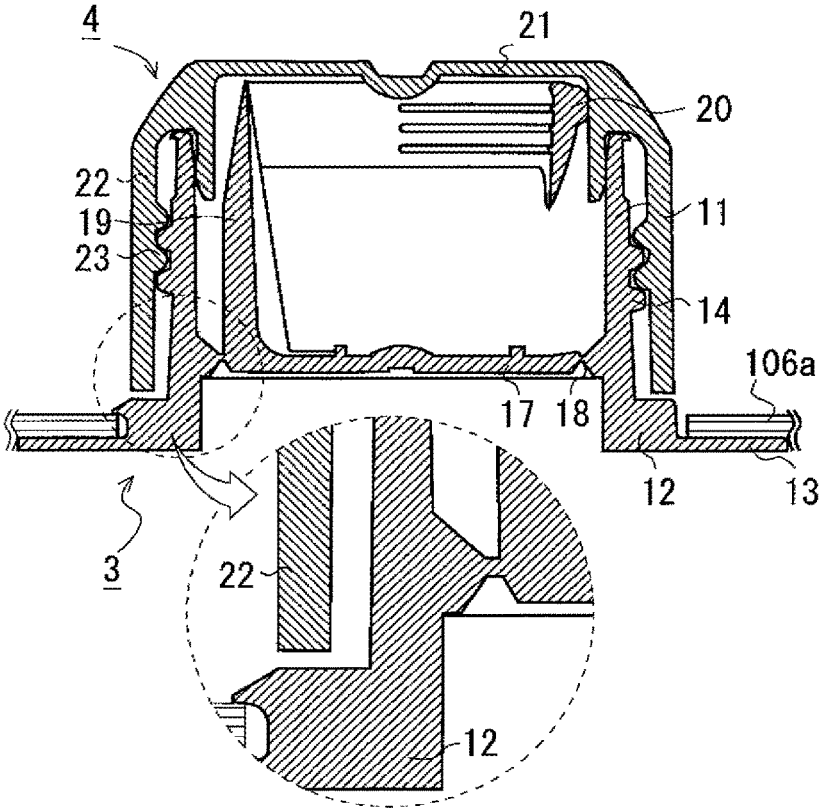
FIG. 8B is a cross-sectional view of a spout assembly according to a comparative example.

As the Comparative Example, a modification of the spout assembly 1 was produced that had no projection 15, recess 16, and fitting portion 24, and was welded to a container body 100 to produce a packaging container. The welding conditions were the same as Example 1. FIG. 8B is a cross-sectional view of the spout assembly of the Comparative Example.

(Evaluation of Ease of Separation)

Ten packaging containers were prepared for each of Examples 1, 2, and 3 and the Comparative Example, and evaluated for ease of separation of spout assemblies from the packaging containers using the separation method 1.

(Measurement of Overrun Torque)

A cap 4 was screwed onto each spout, and overrun torque was measured.

(Drop Test 1)

The packaging containers were dropped up to three times, with the tops thereof directed downward, from a height of 800 mm, onto a concrete surface. Then, they were evaluated for leakage of the liquid contents due to breakage of their spout assemblies.

(Drop Test 2)

The packaging containers were dropped up to three times, with the sidewall 111 in contact with the roof panel 106 formed with the spout assembly 114 directed downward, from a height of 800 mm to a concrete surface. Then, they were evaluated for leakage of the liquid contents due to breakage of their spout assemblies.

(Measurement of Dimensions)

The height from the bottom surface of the flange 13 to the upper surface of the top plate 21 was measured for each of the spout assemblies welded. The spout assemblies of Examples 1 and 2 were visually checked for deformation of the recess 16.

Table 1 shows the evaluation results. Note that the results for ease of separation show "the number of packaging containers separated"/"the number of packaging containers evaluated".

TABLE 1

| | Example 1 | Example 2 | Example 3 | Comparative Example |
|---|---|---|---|---|
| Evaluation of ease of separation | 10/10 | 10/10 | 7/10 | 0/10 |
| Overrun torque | 226 Nm | 206 Nm | 190 Nm | 225 Nm |
| Drop test 1 | No breakage | No breakage | Broken on the third drop | No breakage |
| Drop test 2 | No breakage | No breakage | Broken on the third drop | No breakage |

The evaluation results show that the spout assemblies of Examples 1 and 2 were all separated from the ten packaging containers, while the spout assemblies of Example 3 were separated from seven packaging containers. This demonstrates ease of separation of the spout assembly according to the present invention. In contrast, no spout assemblies of the Comparative Example were separated from the ten packaging containers.

For the spout assemblies of Examples 1 and 2, overrun torque was greater than that of the spout assemblies of Example 3. This indicates that the projection 15 increases the rigidity of the sidewall 11 even if the recess 16 is formed, making overrun less likely to occur, and thus demonstrating that the presence of the projection 15 is more preferable.

The spout assemblies of Examples 1 and 2 did not break in the drop tests 1 and 2. The spout assemblies of Example 3 did not break on the first two drops in the drop tests 1 and 2, indicating their certain rigidity, but broke on the third drop. This indicates that the fitting portion 24 ensures sufficient rigidity of the spout assemblies even if the recess 16 is formed, thus demonstrating that the presence of the fitting portion 24 is more preferable.

The spout assemblies of Examples 1, 2, and 3 and the Comparative Example all had heights satisfying a standard (18.5 mm or less). Furthermore, the recesses 16 of the spout assemblies of Examples 1, 2, and 3 did not deform. This indicates that a spout assembly with a recess 16 does deform when welded.

As described above, the present invention provides a spout assembly that is better prevented from breaking due to ultrasonic vibration during welding and is more readily separated from a packaging container when being broken down, and a packaging container with the spout assembly.

INDUSTRIAL APPLICABILITY

The present invention is useful for paper packaging containers or the like for storing liquids or the like.

REFERENCE SIGNS LIST

1, 5 . . . Packaging container; 2 . . . Spout Assembly; 3 . . . Spout; 4 . . . Cap; 11 . . . Sidewall; 12 . . . Base; 13 . . . Flange; 14 . . . External thread; 15 . . . Projection; 16 . . . Recess; 17 . . . Partition wall; 18 . . . Half-cut portion; 19 . . . Pillar; 20 . . . Pull ring; 21 . . . Top plate; 22 . . . Peripheral wall; 23 . . . Internal thread; 24 . . . Fitting portion; 100, 200 . . . Container body; 101 . . . Top section; 102 . . . Body section; 103 . . . Bottom section; 105 . . . Weakened portion; 106*a*, 106*b* . . . Roof panel; 107 . . . Fold-back panel; 108 . . . Fold-inward panel; 110, 210 . . . Blank; 114 . . . Pouring opening.

What is claimed is:

1. A spout assembly comprising:

a spout including a cylindrical sidewall, a cylindrical base provided at a lower end of the sidewall and having a larger outer diameter than the sidewall, and a disk-like flange extending outward from a lower end of the base; and, a cap having a cylindrical peripheral wall with an internal thread and screwed from an upper end side of the spout sidewall, wherein the spout sidewall has an external thread engaging the internal thread of the cap and a recess located between the external thread and the base, and wherein the spout sidewall has a projection formed between the external thread and the recess so as to extend circumferentially and have a height lower than a height of the external thread, and with the cap screwed onto the spout, at least a portion of an upper surface of the base fits an inner side of a peripheral wall of the cap.

2. The spout assembly of claim 1, wherein a width of the recess between the projection and the base decreases toward the center of the spout sidewall.

3. The spout assembly of claim 1, wherein a disk-like partition wall is provided to an inner surface of the spout sidewall to close an upper end side and a lower end side, and the recess is formed on the lower end side in a position below the partition wall.

4. A packaging container, comprising: a container body having a pouring opening; and the spout assembly of claim 1 having its sidewall inserted into the pouring opening and its flange sealed to the container body.

* * * * *